US010132213B2

(12) United States Patent
Hamasaki et al.

(10) Patent No.: US 10,132,213 B2
(45) Date of Patent: Nov. 20, 2018

(54) VALVE OPENING AND CLOSING TIMING CONTROL APPARATUS

(71) Applicant: AISIN SEIKI KABUSHIKI KAISHA, Kariya-shi, Aichi-ken (JP)

(72) Inventors: Hiroyuki Hamasaki, Obu (JP); Yuji Noguchi, Obu (JP); Takeo Asahi, Kariya (JP); Toru Sakakibara, Kariya (JP); Tomohiro Kajita, Kariya (JP); Hideyuki Suganuma, Anjo (JP); Tomokazu Harada, Aichi-ken (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 119 days.

(21) Appl. No.: 15/266,110

(22) Filed: Sep. 15, 2016

(65) Prior Publication Data

US 2017/0130620 A1 May 11, 2017

(30) Foreign Application Priority Data

Nov. 11, 2015 (JP) ..... 2015-221461

(51) Int. Cl.

| | |
|---|---|
| ***F01L 1/34*** | (2006.01) |
| ***F01L 1/344*** | (2006.01) |
| ***F01L 1/02*** | (2006.01) |

(52) U.S. Cl.

CPC ..... *F01L 1/3442* (2013.01); *F01L 1/022* (2013.01); *F01L 2001/3443* (2013.01); *F01L 2001/3444* (2013.01); *F01L 2001/34433* (2013.01); *F01L 2001/34436* (2013.01); *F01L 2001/34469* (2013.01); *F01L 2001/34479* (2013.01); *F01L 2001/34483* (2013.01); *F01L 2101/00* (2013.01); *F01L 2103/00* (2013.01); *F01L 2810/04* (2013.01)

(58) Field of Classification Search

CPC ..... F01L 1/3442; F01L 2001/3443; F01L 2001/34433; F01L 2001/34436; F01L 2001/34469

USPC ..... 123/90.15, 90.17

See application file for complete search history.

(56) References Cited

U.S. PATENT DOCUMENTS

| | | | | |
|---|---|---|---|---|
| 7,162,984 | B2 * | 1/2007 | Sato | F01L 1/022 123/90.15 |
| 2012/0097122 | A1 | 4/2012 | Lichti | |
| 2016/0076408 | A1 | 3/2016 | Nagura et al. | |

FOREIGN PATENT DOCUMENTS

| | | |
|---|---|---|
| JP | 2016-61174 A | 4/2016 |

* cited by examiner

*Primary Examiner* — Ching Chang

(74) *Attorney, Agent, or Firm* — Buchanan Ingersoll & Rooney PC

(57) ABSTRACT

A valve opening and closing timing control apparatus includes: a driving side rotor synchronously rotating with a crankshaft of an engine; a driven side rotor disposed coaxially with the driving side rotor and synchronously rotating with a camshaft in the internal combustion engine; a fluid pressure chamber formed on at least one of the driving side and driven side rotors, and partitioned into advance angle and retard angle chambers; a bolt disposed coaxially with a rotary axis of the driven side rotor, connecting the driven side rotor and the camshaft, and including a cylindrical portion coaxial with the rotary axis; and a partition body including a press-fit portion press-fitted into the cylindrical portion, and partitioning the cylindrical portion into first and second flow passages for use for feeding and discharging working fluid to and from the fluid pressure chamber, wherein the press-fit portion is provided with a cutting portion.

8 Claims, 6 Drawing Sheets

VALVE OPENING AND CLOSING TIMING CONTROL APPARATUS

CROSS REFERENCE TO RELATED APPLICATIONS

This application is based on and claims priority under 35 U.S.C. § 119 to Japanese Patent Application 2015-221461, filed on Nov. 11, 2015, the entire contents of which are incorporated herein by reference.

TECHNICAL FIELD

This disclosure relates to a valve opening and closing timing control apparatus provided with a partition body that partitions a flow passage space for circulating fluid.

BACKGROUND DISCUSSION

In a valve opening and closing timing control apparatus of an internal combustion engine, an oil control valve (OCV) may be provided in a flow passage space formed in a bolt for fixing a driven side rotor to a camshaft (for example, US 2012/097122 (Reference 1)). The flow passage space of the bolt is formed coaxially with the driven side rotor, and a partition body that partitions the flow passage space into a flow passage for supplying working fluid to an advance angle chamber or a retard angle chamber and a flow passage for discharging the working fluid from the advance angle chamber or the retard angle chamber is press-fitted into the flow passage space.

In a configuration of Reference 1, the bolt and the partition body are configured with same type of metal material. In this case, a cylindrical bolt which is located on the outer side is diametrically enlarged and deformed in many cases. This is because the bolt being subjected to the circumferential tensile deformation on the outer side is more easily deformed than the partition body being compressed on the inner side. For this reason, it is necessary to consider the amount of deformation of the bolt when the clearance between the bolt and other members on the outer peripheral side thereof is set. It is also conceivable to make a strength of the bolt higher than that of the partition body so as to suppress deformation of the bolt. However, the reliability of the bolt when functioning to receive a high axial force is reduced, and, for example, toughness is reduced when the strength of the bolt is increased.

Thus, a need exists for a valve opening and closing timing control apparatus which is not suspectable to the drawback mentioned above.

SUMMARY

A feature of a valve opening and closing timing control apparatus according to an aspect of this disclosure resides in that the apparatus includes a driving side rotor that synchronously rotates with a crankshaft of an internal combustion engine, a driven side rotor that is disposed coaxially with the driving side rotor and synchronously rotates with a camshaft in the internal combustion engine, a fluid pressure chamber that is formed on at least one of the driving side rotor and the driven side rotor, and is partitioned into an advance angle chamber and a retard angle chamber, a bolt that is disposed coaxially with a rotary axis of the driven side rotor, connects the driven side rotor and the camshaft, and includes a cylindrical portion coaxial with the rotary axis, and a partition body that includes a press-fit portion press-fitted into the cylindrical portion, and partitions the cylindrical portion into a first flow passage and a second flow passage for use for feeding and discharging working fluid to and from the fluid pressure chamber. The press-fit portion is provided with a cutting portion for cutting an inner peripheral surface of the cylindrical portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment disclosed here will be described with reference to drawings.

Basic Configuration

Figure 1:
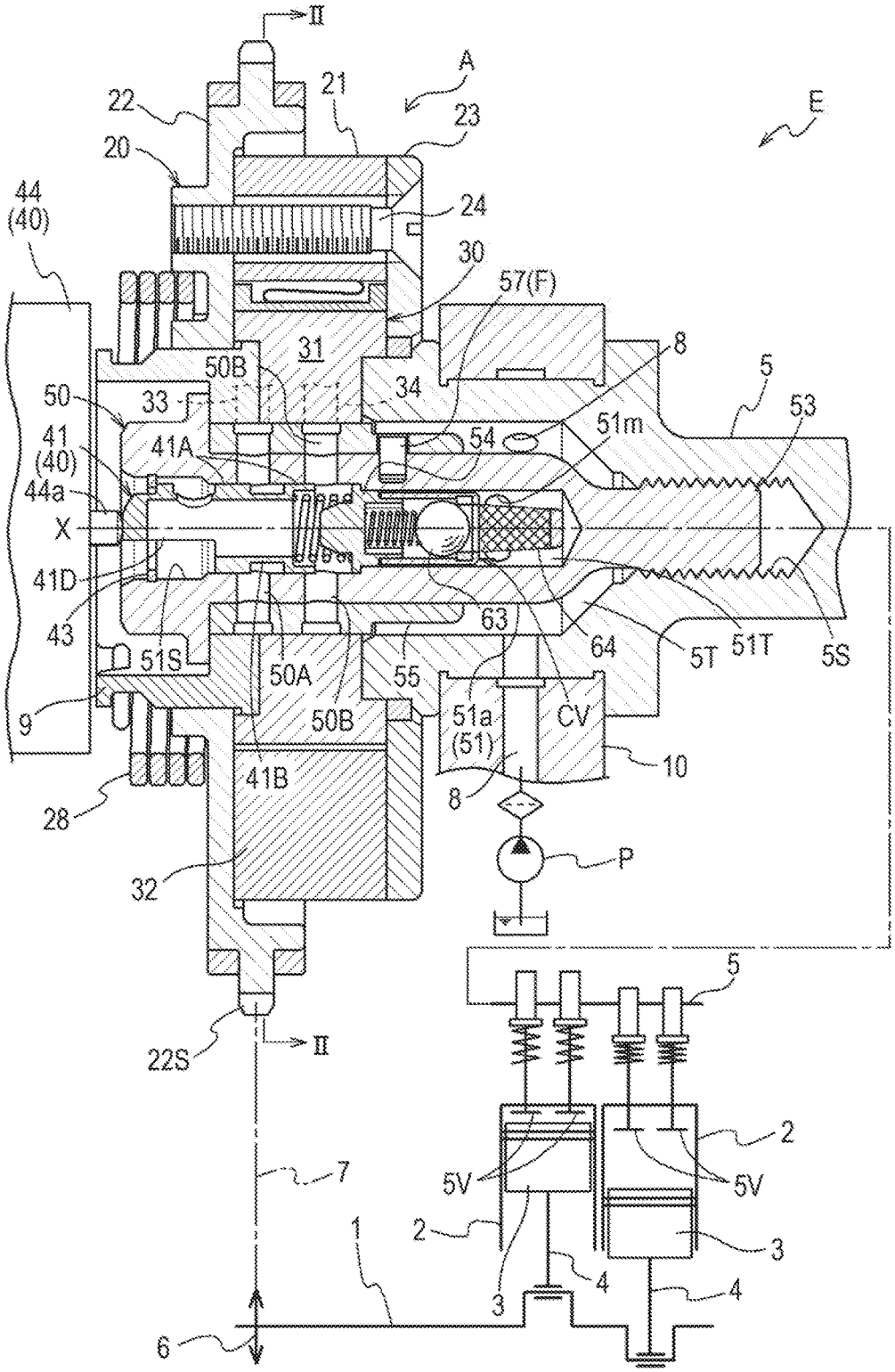
FIG. 1 is a sectional view illustrating an entire configuration of a valve opening and closing timing control apparatus.
Figure 2:
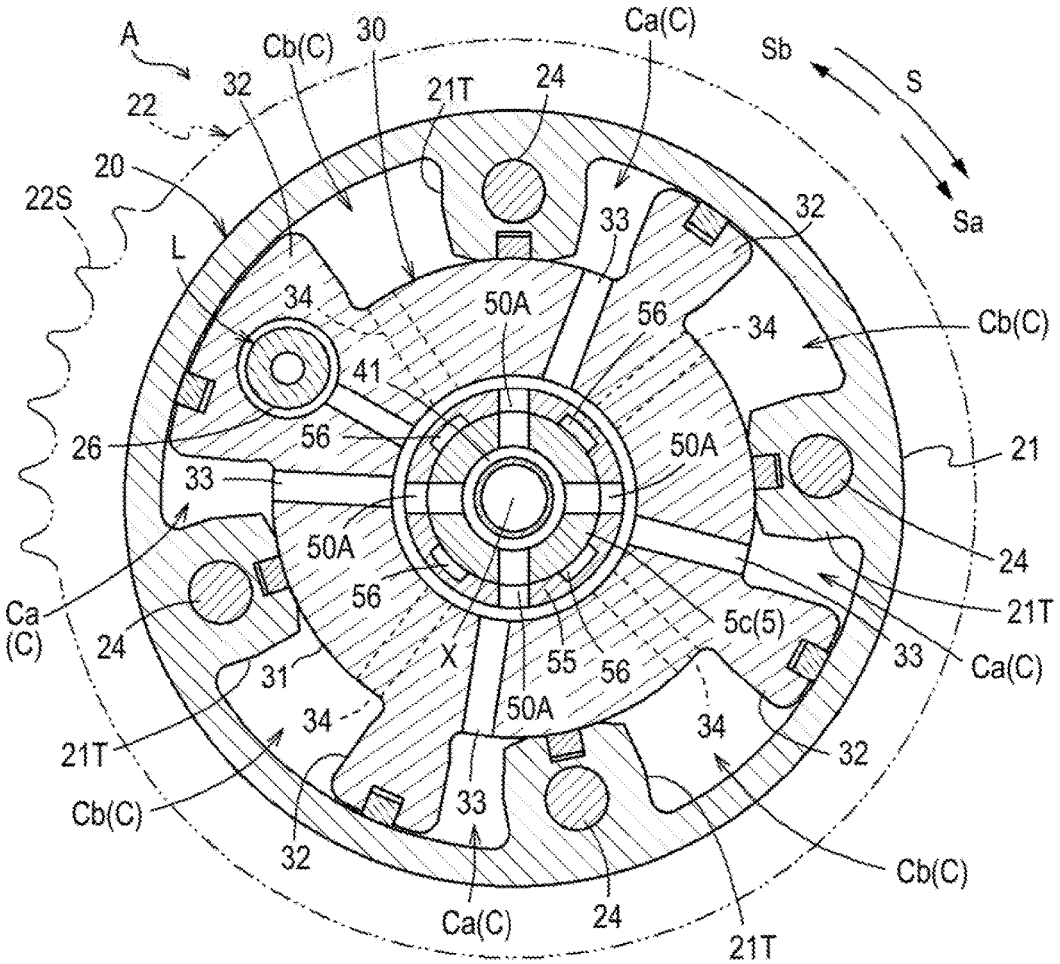
FIG. 2 is a sectional view taken along line II-II in FIG. 1.

As illustrated in FIG. 1 and FIG. 2, a valve opening and closing timing control apparatus A is configured to include an external rotor 20 as a driving side rotor, an internal rotor 30 as a driven side rotor, and a solenoid control valve 40 controlling a hydraulic oil as a working fluid.

The internal rotor 30 (one example of the driven side rotor) is disposed coaxially with a rotary axis X of an intake camshaft 5, and is screwed and connected to the intake camshaft 5 by a connecting bolt 50 so as to rotate integrally. The external rotor 20 (one example of the driving side rotor) is disposed on the coaxial core with the rotary axis X, and is relatively rotatably supported to the internal rotor 30 by containing the internal rotor 30. This external rotor 20 synchronously rotates with a crankshaft 1 of an engine E as an internal combustion engine.

The solenoid control valve 40 is provided with an electromagnetic solenoid 44 supported by the engine E, and is provided with a spool 41 and a spool spring 42 accommodated in a spool chamber 51S of the connecting bolt 50.

The electromagnetic solenoid 44 is provided with a plunger 44*a* disposed at the coaxial core with the rotary axis X so as to abut on an outer end portion of the spool 41, and sets the amount of projection of the plunger 44*a* to set an operation position of the spool 41 by control of electric power to be supplied to a solenoid inside thereof. Thereby, the electromagnetic solenoid 44 controls the hydraulic oil (one example of the working fluid), and a relative rotational phase of the external rotor 20 and the internal rotor 30 is set by control of the hydraulic oil. Therefore, control of an opening and closing timing of an intake valve 5V is realized.

Engine and the Valve Opening and Closing Timing Control Apparatus

The engine E (one example of the internal combustion engine) in FIG. 1 indicates that is provided in the vehicle such as a passenger car. This engine E accommodates a piston 3 in the inside of a cylinder bore in a cylinder block 2 of the upper position, and is configured with four-cycle type to connect the piston 3 and the crankshaft 1 with a connecting rod 4. The intake camshaft 5 opening and closing the intake valve 5V and an exhaust camshaft (not illustrated) are provided in upper side of the engine E.

In an engine constituting member 10 rotatably supporting the intake camshaft 5, a supply flow passage 8 is formed to supply the hydraulic oil from a hydraulic pump P (one example of the fluid pressure pump) driven by the engine E. The hydraulic pump P supplies lubricating oil stored in the oil pan of the engine E to the solenoid control valve 40 as the hydraulic oil (one example of the working fluid) via the supply flow passage 8.

A timing chain 7 is wound over an output sprocket 6 formed in the crankshaft 1 of the engine E and a timing sprocket 22S of the external rotor 20. Thereby, the external rotor 20 synchronously rotates with the crankshaft 1. A sprocket is provided to the front end of the exhaust camshaft of exhaust side, and the timing chain 7 is wound in this sprocket.

As illustrated in FIG. 2, the external rotor 20 rotates toward a driving rotational direction S by the driving force from the crankshaft 1. The direction in which the internal rotor 30 is relatively rotated in the same direction as the driving rotational direction S with respect to the external rotor 20 is referred to as an advance angle direction Sa, and the reverse direction thereof is referred to as a retard angle direction Sb. In this valve opening and closing timing control apparatus A, relationship between the crankshaft 1 and the intake camshaft 5 is set so as to increase an intake air compression ratio in accordance with increase of the amount of displacement when the relative rotational phase is displaced in the advance angle direction Sa, and so as to reduce the intake air compression ratio in accordance with the increase of the amount of displacement when the relative rotational phase is displaced in the retard angle direction Sb.

Although the valve opening and closing timing control apparatus A is provided in the intake camshaft 5 in this embodiment, the valve opening and closing timing control apparatus A may be provided in the exhaust camshaft, or may be provided in both of the intake camshaft 5 and the exhaust camshaft.

The external rotor 20 includes an external rotor main body 21, a front plate 22, and a rear plate 23, and these portions are integrated by engagement of a plurality of fastening bolts 24. The timing sprocket 22S is formed on an outer periphery of the front plate 22. An annular member 9 is relatively rotatably disposed on an inner periphery of the front plate 22, and a bolt head 52 of the connecting bolt 50 is crimped with respect to this annular member 9. Therefore, this annular member 9, an internal rotor main body 31, and the intake valve 5V are integrated.

Hydraulic Control Configuration

A plurality of projecting portions 21T projecting towards the inside in a radial direction is integrally formed in the external rotor main body 21. The internal rotor 30 includes the cylindrical internal rotor main body 31 which is brought into close contact with the projecting portion 21T of the external rotor main body 21, and four vane portions 32 which project towards the outside in the radial direction from the outer periphery of the internal rotor main body 31 so as to come into contact with an inner peripheral surface of the external rotor main body 21.

Thereby, the external rotor 20 contains the internal rotor 30, and a plurality of fluid pressure chambers C are formed on the outer periphery side of the internal rotor main body 31 at an intermediate position of the projecting portions 21T adjacent to each other in the rotation direction. These fluid pressure chambers C are partitioned by the vane portion 32, and an advance angle chamber Ca and a retard angle chamber Cb are partitioned and formed. An advance angle flow passage 33 communicating with the advance angle chamber Ca is formed in the internal rotor 30, and a retard angle flow passage 34 communicating with the retard angle chamber Cb is formed in the internal rotor 30.

As illustrated in FIG. 1, a torsion spring 28 assisting a displacement of the relative rotational phase between the external rotor 20 and the internal rotor 30 (hereinafter, referred to as the relative rotational phase) to the advance angle direction Sa by the action of biasing force from most retarded angle phase to the advance angle direction Sa is provided over the external rotor 20 and the annular member 9.

A locking mechanism L locking (fixing) the relative rotational phase between the external rotor 20 and the internal rotor 30 in the most retarded angle phase is provided. This locking mechanism L is configured to be provided with a locking member 26 supported freely movable in the direction along the rotary axis X with respect to one vane portion 32, a locking spring projecting and biasing this locking member 26, and a locking recess portion formed on the rear plate 23. The locking mechanism L may be configured to be provided with the locking member 26 guided so as to be moved along the radial direction.

The relative rotational phase reaches the most retarded angle phase. Therefore, the locking member 26 is engaged with the locking recess portion by the biasing force of the locking spring, and this locking mechanism L serves to maintain the relative rotational phase to the most retarded angle phase. In a case where the advance angle flow passage 33 communicates with the locking recess portion, and the hydraulic oil is supplied to the advance angle flow passage 33, the locking mechanism L is also configured to perform lock releasing to detach the locking member 26 from the locking recess portion by a hydraulic oil pressure.

Connecting Bolt

Figure 3:
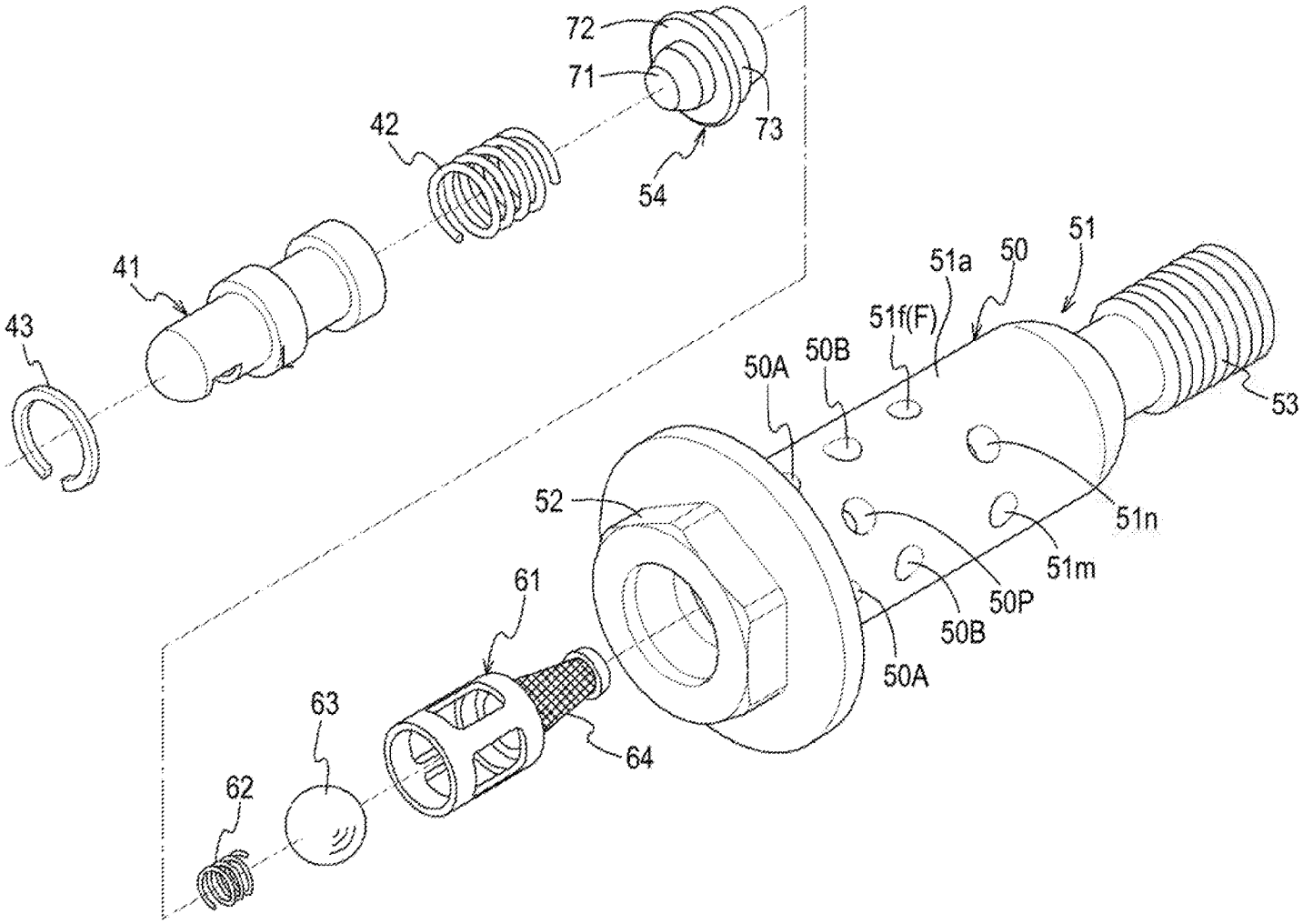
FIG. 3 is an exploded perspective view illustrating a bolt provided with a fluid control valve.
Figure 4:
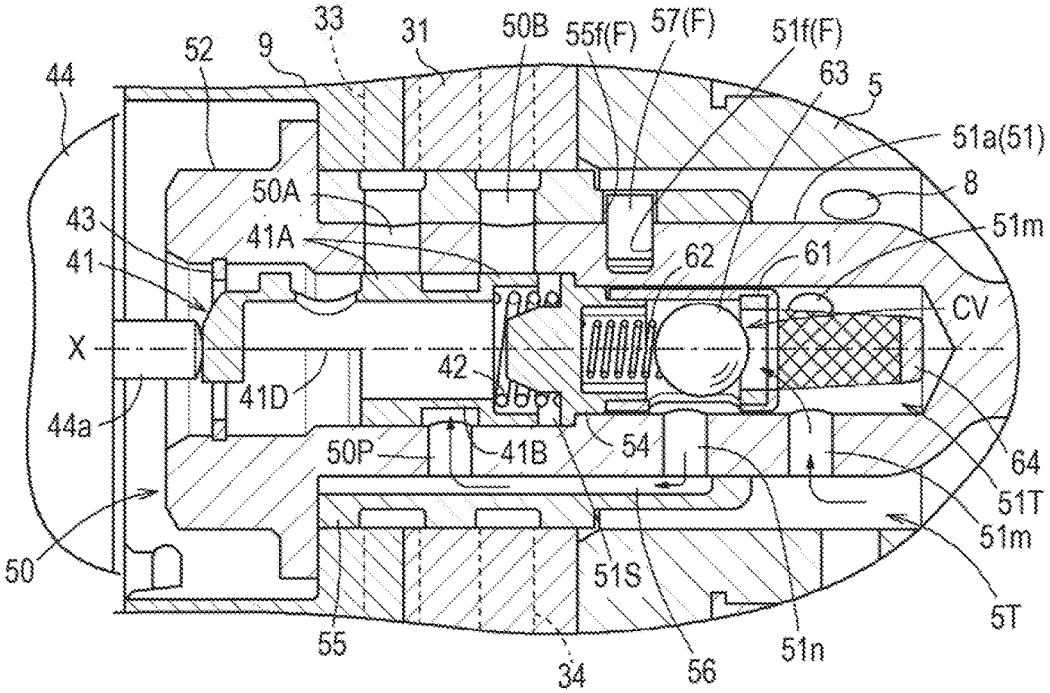
FIG. 4 is a sectional view illustrating the bolt and a flow passage in the vicinity of the bolt.
Figure 5:
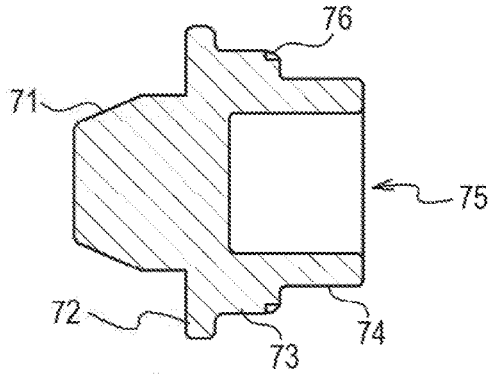
FIG. 5 is a vertical cross-sectional view illustrating a partition body.
Figure 6:
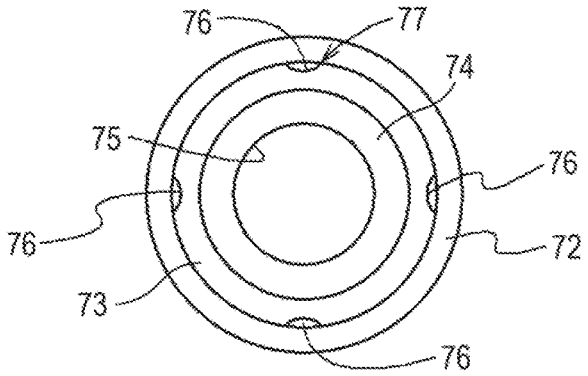
FIG. 6 is a front view illustrating the partition body.
Figure 7:
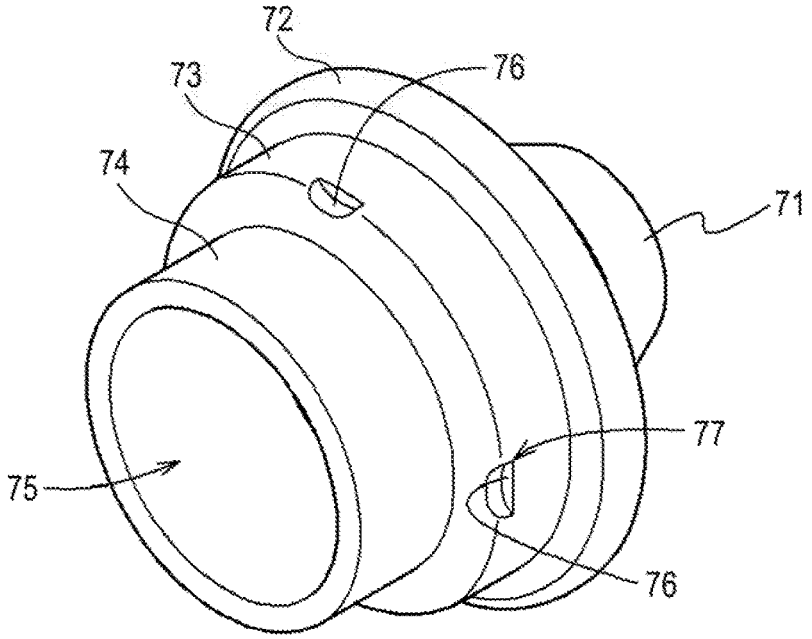
FIG. 7 is a perspective view illustrating the partition body.

As illustrated in FIG. 1, and FIG. 3 to FIG. 4, the connecting bolt 50 is provided with a bolt body 51 of which a portion is cylindrical, a cylindrical sleeve 55 fitted in a cylindrical portion 51 a of the bolt body 51, and an engagement pin 57 as an engagement member positioning these portions.

In the intake camshaft 5, a female threaded portion 5S is formed around the rotary axis X, and an inside space of the shaft 5T as a larger diameter than the female threaded portion 5S is formed so that the sleeve 55 is tightly fitted. The inside space of the shaft 5T communicates with the supply flow passage 8 as described above. The hydraulic oil is supplied from the hydraulic pump P to the inside space of the shaft 5T.

The bolt head 52 is formed on the outer end portion of the bolt body 51, and a male threaded portion 53 is formed on an inner end portion. Based on this configuration, the male threaded portion 53 of the bolt body 51 is screwed to the female threaded portion 5S of the intake camshaft 5, and the internal rotor 30 is fastened to the intake camshaft 5 by rotational operation of the bolt head 52. In this fastening state, an inner end side of the outer periphery (male screw side) of the sleeve 55 being fitted in the bolt body 51 is in close contact with the inner peripheral surface of the inside space of the shaft 5T, and an outer end side (bolt head side) is in close contact with the inner peripheral surface of the internal rotor main body 31.

In the inside of the bolt body 51, the hole-shaped cylindrical portion 51*a* is formed towards the male threaded portion 53 from the bolt head 52 (in the direction of rotary axis X). A retainer 54 (one example of a partition body) is press-fitted and fixed to the cylindrical portion 51*a*. The cylindrical portion 51*a* is divided into the spool chamber 51S (one example of a second flow passage) and a hydraulic oil chamber 51T (one example of a first flow passage) as a fluid chamber by the retainer 54.

As illustrated in FIG. 5 to FIG. 8, the retainer 54 has a locking portion 71, a flange 72, a press-fit portion 73, and an engaging portion 74 in order from the spool chamber 51S side. The locking portion 71 projects towards the spool chamber 51S from the flange 72 to hold the spool spring 42. A stepped portion 51*d* is disposed at a boundary between the spool chamber 51S and the hydraulic oil chamber 51T in the cylindrical portion 51*a*, and the flange 72 abuts on the stepped portion 51*d*. The press-fit portion 73 is press-fitted into the inner peripheral surface of the cylindrical portion 51*a*. The engaging portion 74 is engaged with a ball holder (one example of a valve housing body) 61 of a valve body described later.

The retainer 54 is open on the side of the hydraulic oil chamber 51T, and is provided with a hole portion 75 formed along the rotary axis X. A plurality of cutouts 76 (four in FIG. 6) is formed at locations evenly distributed in a circumferential direction on an end portion outer periphery of the press-fit portion 73. Since the cutout 76 does not abut on the inner peripheral surface of the cylindrical portion 51*a*, a surface pressure of an outer peripheral portion 77 without the cutout is increased. For this reason, an inner surface of the bolt body 51 may be cut by this outer peripheral portion 77. That is, the outer peripheral portion 77 functions as a cutting portion of the press-fit portion 73. In this manner, it is possible to cause the retainer 54 to have a cutting function by simple processing of disposing the cutout 76 on the end portion outer periphery of the press-fit portion 73. Therefore, it is possible to appropriately attach the retainer 54 to the bolt body 51.

In the valve opening and closing timing control apparatus A, if the retainer 54 is press-fitted from the opening of the cylindrical portion 51*a* to partition the cylindrical portion 51*a* formed in the connecting bolt 50 for an OCV use, the cylindrical bolt body 51 which is located on the outside is diametrically enlarged and deformed in many cases. That is because the bolt body 51 receiving the tensile deformation in the outside and in a circumferential direction is easily deformed than the retainer 54 being compressed in the inside. In the embodiment, since the cutting portion 77 for cutting an inner surface of the bolt body 51 at the press-fit portion 73 in the retainer 54 is disposed, when the retainer 54 is press-fitted into the bolt body 51, the inner peripheral surface of the cylindrical portion 51*a* is cut. Thereby, the inner surface of the bolt body 51 is cut so that the deformation of the bolt body 51 outward in the radial direction is suppressed. As a result, clearance between the bolt body 51 and the other member of the outer peripheral side is easily set.

The spool chamber 51S is formed in a cylinder inner surface shape and the spool 41 as described above is reciprocally movably accommodated along the rotary axis X in the spool chamber 51S. Therefore, the spool spring 42 is disposed between the inside end of this spool 41 and the retainer 54. Thereby, the spool 41 is biased so as to project in the direction of the outer end side (direction of the bolt head 52).

In the bolt body 51, a plurality of acquisition flow passages 51*m* communicating the hydraulic oil chamber 51T and the inside space of the shaft 5T are formed and a plurality of intermediate flow passages 51*n* are formed between the hydraulic oil chamber 51T and the outer peripheral surface of the bolt body 51.

A check valve CV is provided in the flow passage sending the hydraulic oil from the acquisition flow passage 51*m* to the intermediate flow passage 51*n* in the hydraulic oil chamber 51T. This check valve CV is configured with the ball holder 61 (one example of the valve housing body), a check spring 62, and a check ball 63 (one example of the valve body).

In this check valve CV, the check spring 62 is disposed between the retainer 54 and the check ball 63 and the check ball 63 is in pressure contact with an opening of the ball holder 61 by the biasing force of the check spring 62 to close the flow passage. An oil filter 64 removing dust from the hydraulic oil flowing toward the check ball 63 is provided in the ball holder 61.

Figure 8:
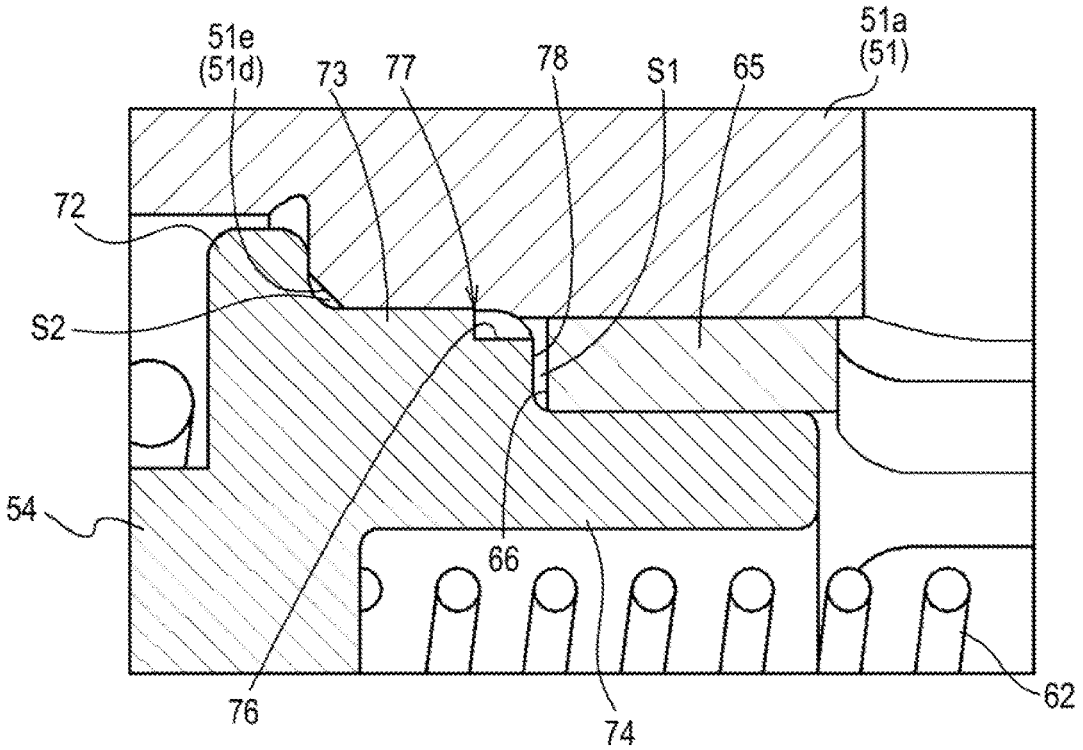
FIG. 8 is a sectional view illustrating a main part of a flow passage partition structure with the partition body.

As illustrated in FIG. 8, the ball holder 61 is open towards the spool chamber 51S, an end portion of the side of the spool chamber 51S is configured as an engaged portion 65 externally fitted to the engaging portion 74 of the retainer 54. The ball holder 61, for example, is configured with a resin material or the like. A space S1 is formed between an end surface 66 of the retainer 54 side of the engaged portion 65 and the end surface (end surface formed between the press-fit portion 73 and the engaging portion 74) 78 of the retainer 54 facing thereto.

When the retainer 54 is press-fitted into the bolt body 51, by the cutting portion 77 disposed at the press-fit portion 73, the inner surface of the bolt body 51 is cut to generate chip. Since the space S1 is disposed at the downstream side in the insertion direction of the press-fit portion 73, the chip (foreign matter) is confined in the space S1 so that the outflow of foreign matter into the flow passage may be prevented. That is, the space S1 may be used as a foreign matter reservoir.

The foreign matter generated when the retainer 54 is press-fitted into the bolt body 51 may be generated in the side of the spool chamber 51S which is the downstream side in an insertion direction of the press-fit portion 73. Therefore, a space S2 is formed functioning as the foreign matter reservoir between the stepped portion 51*d* disposed at the boundary between the spool chamber 51S and the hydraulic oil chamber 51T, and a base portion in the radial direction of the flange 72 of the retainer 54. A corner portion 51*e* of the stepped portion 51*d* is chamfered so that the space S2 is extended. Thereby, the foreign matter which is generated on the upperstream side in the insertion direction of the press-fit portion 73 is confined in the space S2 so that the outflow of foreign matter into the flow passage may be prevented.

In a case where the pressure of the hydraulic oil supplied to the hydraulic oil chamber 51T exceeds a predetermined value, the check valve CV opens the flow passage against the biasing force of the check spring 62 and in a case where the pressure is decreased less than the predetermined value, the check valve CV closes the flow passage by the biasing force of the check spring 62. By this operation, when the pressure of the hydraulic oil is decreased, reverse flow of the hydraulic oil from the advance angle chamber Ca or the retard angle chamber Cb is prevented and variation of the phase of the valve opening and closing timing control apparatus A is suppressed. Even in a case where the pressure of a downstream side of the check valve CV exceeds a predetermined value, this check valve CV performs closing operation.

Solenoid Control Valve

As described above, the solenoid control valve 40 is provided with the spool 41, the spool spring 42, and the electromagnetic solenoid 44.

A pair of pump ports 50P communicating the spool chamber 51S and the outer peripheral surface of the bolt body 51 are formed as a through hole in the bolt body 51. A plurality of advance angle ports 50A and a pair of retard angle ports 50B communicating the spool chamber 51S and the outer peripheral surface of the sleeve 55 are formed as the through hole over the bolt body 51 and the sleeve 55 in the connecting bolt 50.

The advance angle port 50A, the pump port 50P, and the retard angle port 50B are disposed in the inner end side from the outer end side of the connecting bolt 50 in this order. The advance angle port 50A and the retard angle port 50B in the direction as viewed along the rotary axis X are formed in the overlapping positions with each other and the pump port 50P is formed in a position that does not overlap with these ports.

On the outer periphery of the sleeve 55, an annular groove is formed in which the plurality of advance angle ports 50A communicate and the plurality of advance angle ports 50A communicate with the plurality of advance angle flow passages 33 from the annular groove. In the same way, on the outer periphery of the sleeve 55, an annular groove is formed in which the plurality of retard angle ports 50B communicate and the plurality of retard angle ports 50B communicate with the plurality of retard angle flow passages 34 from the annular groove. Furthermore, an introduction flow passage 56 communicating the intermediate flow passage 51*n* and the pump port 50P is formed in a groove shape on the inner peripheral surface of the sleeve 55.

That is, the sleeve 55 is shaped at a dimension reaching the intermediate flow passage 51*n* from the bolt head 52 of the bolt body 51 and the introduction flow passage 56 is formed in a region avoiding the advance angle port 50A and the retard angle port 50B.

A first engaging portion 51*f* having a recessed shape is formed at a position deviated from a press-fitted and fixed position of the retainer 54 in the direction along the rotary axis X in the bolt body 51, and a second engaging portion 55*f* having a hole shape penetrating in the radial direction is formed in the sleeve 55. Therefore, the engagement pin 57 is provided to engage with both portions over the first engaging portion 51*f* and the second engaging portion 55*f*.

By the engagement of the engaging portions 51*f* and 55*f*, and the engagement pin 57, a relative posture of the rotation around the rotary axis X of the bolt body 51 and the sleeve 55 and a relative position thereof along the rotary axis X are determined. Thereby, the hydraulic oil from the hydraulic oil chamber 51T may be supplied to the pump port 50P via the introduction flow passage 56.

The spool 41 forms an abutting surface on which the plunger 44*a* abuts on the outer end side, forms land portions 41A at two positions in the direction along the rotary axis X, and forms a groove portion 41B at an intermediate position of these land portions 41A. This spool 41 is formed in a hollow and a drain hole 41D is formed on a projecting end of the spool 41. The spool 41 abuts on a stopper 43 provided on an inner peripheral opening of the outer end side of the connecting bolt 50, so that a position of a projecting side is determined.

The solenoid control valve 40 causes the plunger 44*a* to abut on the abutting surface of the spool 41 and controls the amount of projection. Therefore, the solenoid control valve 40 is configured to be capable of setting the spool 41 at a neutral position, a retard angle position, and an advance angle position.

The spool 41 is set at the neutral position illustrated in FIG. 4, so that the advance angle port 50A and the retard angle port 50B are closed by a pair of the land portions 41A of the spool 41. As a result, the feeding and discharging of the hydraulic oil to the advance angle chamber Ca and the retard angle chamber Cb are not preformed and the phase of the valve opening and closing timing control apparatus A is maintained.

The plunger 44*a* is retracted (operated outwards) on the basis of the neutral position (FIG. 4) by the control of the electromagnetic solenoid 44, so that the spool 41 is set at the advance angle position. The pump port 50P communicates with the advance angle port 50A via the groove portion 41B at this advance angle position. At the same time, the retard angle port 50B communicates with the spool chamber 51S from the inner end of the spool 41. Thereby, the hydraulic oil is supplied to the advance angle chamber Ca, the hydraulic oil flows the inside of the spool 41 from the retard angle chamber Cb, and the hydraulic oil is discharged from the drain hole 41D. As a result, rotation phase of the intake camshaft 5 is displaced in the advance angle direction Sa.

In a state where the locking mechanism L is in a lock state, the spool 41 is set at the advance angle position and in a case where the hydraulic oil is supplied to the advance angle flow passage 33, the hydraulic oil is supplied to the locking recess portion of the locking mechanism L from the advance angle flow passage 33. Therefore, the locking member 26 is detached from this locking recess portion and the lock state of the locking mechanism L is released.

The plunger 44*a* is projected (operated inwards) on the basis of the neutral position (FIG. 4) by the control of the electromagnetic solenoid 44, so that the spool 41 is set at the retard angle position. The pump port 50P communicates with the retard angle port 50B via the groove portion 41B at this retard angle position. At the same time, since the advance angle port 50A is allowed to communicate with a drain space (space continued to the outer end side from the spool chamber 51S), the hydraulic oil is discharged from the advance angle chamber Ca, and the hydraulic oil is supplied to the retard angle chamber Cb at the same time. As a result, the rotation phase of the intake camshaft 5 is displaced in the retard angle direction Sb. This retard angle position coincides with the position in which the spool 41 abuts on the stopper 43 by the biasing force of the spool spring 42.

Second Embodiment

Figure 9:
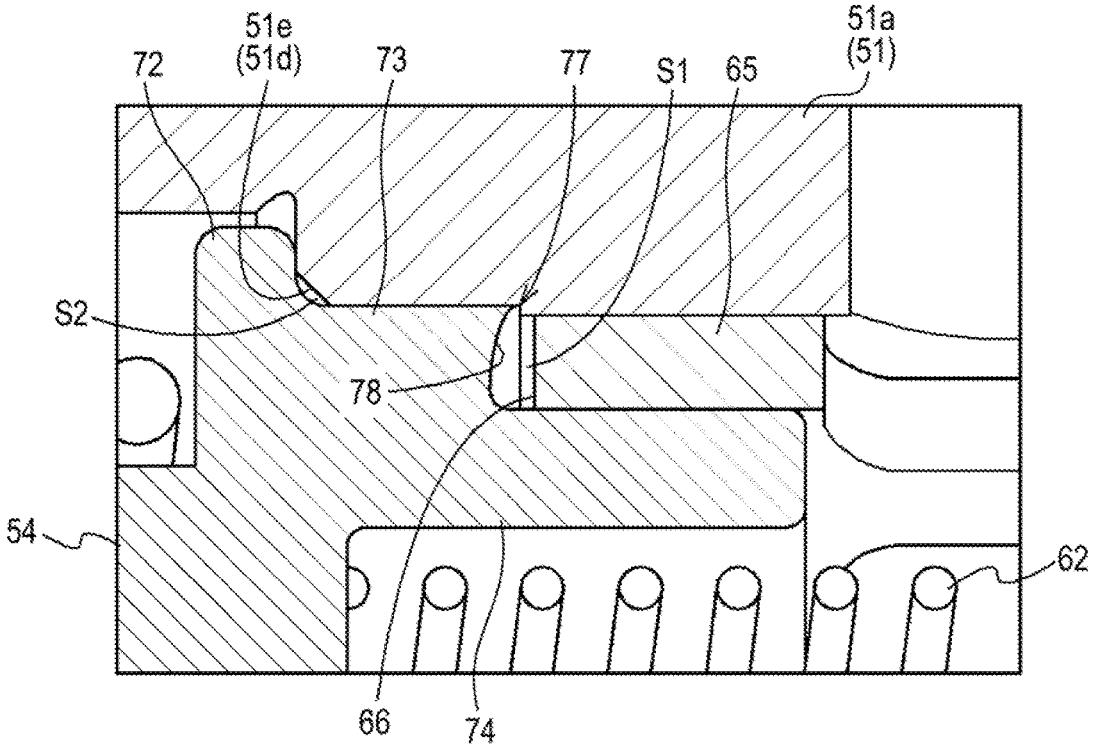
FIG. 9 is a sectional view illustrating a main part of a flow passage partition structure with a partition body of another embodiment.

Although an example in which the cutting portion 77 is configured by a region other than the cutout 76 is described in a first embodiment, in this embodiment, as illustrated in FIG. 9, the cutting portion 77 is configured in a shape in which the end portion outer periphery of the hydraulic oil chamber 51T side of the press-fit portion 73 is projected in an acute angle. This cutting portion 77 is disposed on the entire or part of the end portion outer periphery of the press-fit portion 73.

Other Embodiment

Although an example in which the cutout 76 is formed four in the circumferential direction of the end portion outer periphery of the press-fit portion 73 is described in the first embodiment, the number of the cutout 76 may be three or less or five or more, without the number of the cutout 76 being limited to four. Although an example in which the plurality of cutouts 76 are evenly distributed in the circumferential direction is described in the first embodiment, the plurality of cutouts 76 may not be evenly distributed in the circumferential direction.

The embodiment disclosed here may be used for the valve opening and closing timing control apparatus setting the valve opening and closing timing by a fluid pressure.

A feature of a valve opening and closing timing control apparatus according to an aspect of this disclosure resides in that the apparatus includes a driving side rotor that synchronously rotates with a crankshaft of an internal combustion engine, a driven side rotor that is disposed coaxially with the driving side rotor and synchronously rotates with a camshaft in the internal combustion engine, a fluid pressure chamber that is formed on at least one of the driving side rotor and the driven side rotor, and is partitioned into an advance angle chamber and a retard angle chamber, a bolt that is disposed coaxially with a rotary axis of the driven side rotor, connects the driven side rotor and the camshaft, and includes a cylindrical portion coaxial with the rotary axis, and a partition body that includes a press-fit portion press-fitted into the cylindrical portion, and partitions the cylindrical portion into a first flow passage and a second flow passage for use for feeding and discharging working fluid to and from the fluid pressure chamber. The press-fit portion is provided with a cutting portion for cutting an inner peripheral surface of the cylindrical portion.

In this configuration, since the cutting portion for cutting an inner surface of the bolt is provided in the press-fit portion of the partition body, when the partition body is press-fitted into the bolt, the inner peripheral surface of the cylindrical portion is cut. Thereby, the inner surface of the bolt is cut so that the deformation of the bolt outward in the radial direction is suppressed, and thus a clearance between the bolt and the other member on the outer peripheral side thereof is easily set.

Another feature of the aspect of this disclosure resides in that a cutout is provided on an outer periphery of an end portion of the press-fit portion, and an outer peripheral portion without the cutout functions as the cutting portion.

In this configuration, if the cutout is provided on the outer periphery of the end portion of the press-fit portion, since the cutout portion does not abut on the inner surface of the bolt, a surface pressure of the outer peripheral portion without the cutout is increased. For this reason, the outer peripheral portion functions as the cutting portion so that the inner surface of the bolt can be cut. In this manner, according to this configuration, it is possible to cause the partition body to have a cutting function with simple processing and it is possible to appropriately mount the partition body in the bolt.

Still another feature of the aspect of this disclosure resides in that the apparatus further includes a valve body that opens and closes the first flow passage, and a valve housing body that accommodates the valve body. An engaging portion which has a smaller diameter than that of the press-fit portion is provided closer to the first flow passage than the press-fit portion is, and the valve housing body is provided with an engaged portion which is externally fitted to the engaging portion. A space is formed which functions as a foreign matter reservoir between an end surface of the engaged portion on the partition body side and an end surface of the partition body facing each other.

When the partition body is press-fitted into the cylindrical portion of the bolt, by the cutting portion provided in the press-fit portion, the inner surface of the bolt is cut and chips are generated. If the chips as foreign matter intrude into the flow passage, inconvenience such as adverse effects on the operation of the valve disposed in the flow passage occurs. According to this configuration, the engaging portion which has a smaller diameter than that of the press-fit portion is provided close to the first flow passage which is on a downstream side in an insertion direction of the press-fit portion, and the space is formed which functions as the foreign matter reservoir between the end surface of the engaged portion on the partition body side and the end surface of the partition body (end surface formed between the press-fit portion and the engaging portion) facing each other. Thereby, the foreign matter is confined in the space so that the outflow of foreign matter into the flow passage can be prevented.

Yet another feature of the aspect of this disclosure resides in that a stepped portion is disposed at a boundary between the first flow passage and the second flow passage in the cylindrical portion, and the partition body includes a flange, a portion of which abuts on the stepped portion, in a position adjacent to the press-fit portion. A space is provided which functions as a foreign matter reservoir between a base portion in a radial direction of the flange and the stepped portion.

The chips that are generated when press-fitting the partition body into the cylindrical portion of the bolt may be generated on the second flow passage side which is on an upperstream side in the insertion direction of the press-fit portion. According to this configuration, the flange provided on the partition body and the stepped portion formed on the cylindrical portion of the bolt partially abut each other, and the space functioning as the foreign matter reservoir is provided between the base portion in the radial direction of the flange and the stepped portion. Thereby, the foreign matter is confined in the space so that the outflow of foreign matter into the flow passage can be prevented.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control apparatus comprising:

a driving side rotor that synchronously rotates with a crankshaft of an internal combustion engine;

a driven side rotor that is disposed coaxially with the driving side rotor and synchronously rotates with a camshaft in the internal combustion engine;

a fluid pressure chamber that is formed on at least one of the driving side rotor and the driven side rotor, and is partitioned into an advance angle chamber and a retard angle chamber;

a bolt that is disposed coaxially with a rotary axis of the driven side rotor, connects the driven side rotor and the camshaft, and includes a cylindrical portion coaxial with the rotary axis; and a partition body that includes a press-fit portion press-fitted into the cylindrical portion, and partitions the cylindrical portion into a first flow passage and a second flow passage for use for feeding and discharging working fluid to and from the fluid pressure chamber, wherein the press-fit portion is provided with a cutting portion for cutting an inner peripheral surface of the cylindrical portion.

2. The valve opening and closing timing control apparatus according to claim 1, wherein a cutout is provided on an outer periphery of an end portion of the press-fit portion, and an outer peripheral portion of the press-fit portion not provided with the cutout is the cutting portion.

3. The valve opening and closing timing control apparatus according to claim 2, further comprising:

a valve body that opens and closes the first flow passage; and a valve housing body that accommodates the valve body, wherein an engaging portion which has a smaller diameter than that of the press-fit portion is provided closer to the first flow passage than the press-fit portion is, and the valve housing body is provided with an engaged portion which is externally fitted to the engaging portion, and wherein a space is formed between an end surface of the engaged portion and an end surface of the partition body, the space functioning as a foreign matter reservoir.

4. The valve opening and closing timing control apparatus according to claim 3, wherein a stepped portion is disposed at a boundary between the first flow passage and the second flow passage in the cylindrical portion, and the partition body includes a flange, a portion of which abuts on the stepped portion, in a position adjacent to the press-fit portion, and wherein a second space is provided between a base portion in a radial direction of the flange and the stepped portion, the second space functioning as a second foreign matter reservoir.

5. The valve opening and closing timing control apparatus according to claim 2, wherein a stepped portion is disposed at a boundary between the first flow passage and the second flow passage in the cylindrical portion, and the partition body includes a flange, a portion of which abuts on the stepped portion, in a position adjacent to the press-fit portion, and wherein a space is provided between a base portion in a radial direction of the flange and the stepped portion, the space functioning as a foreign matter reservoir.

6. The valve opening and closing timing control apparatus according to claim 1, further comprising:

a valve body that opens and closes the first flow passage; and a valve housing body that accommodates the valve body, wherein an engaging portion which has a smaller diameter than that of the press-fit portion is provided closer to the first flow passage than the press-fit portion is, and the valve housing body is provided with an engaged portion which is externally fitted to the engaging portion, and wherein a space is formed between an end surface of the engaged portion and an end surface of the partition body, the space functioning as a foreign matter reservoir.

7. The valve opening and closing timing control apparatus according to claim 6, wherein a stepped portion is disposed at a boundary between the first flow passage and the second flow passage in the cylindrical portion, and the partition body includes a flange, a portion of which abuts on the stepped portion, in a position adjacent to the press-fit portion, and wherein a second space is provided between a base portion in a radial direction of the flange and the stepped portion, the second space functioning as a second foreign matter reservoir.

8. The valve opening and closing timing control apparatus according to claim 1, wherein a stepped portion is disposed at a boundary between the first flow passage and the second flow passage in the cylindrical portion, and the partition body includes a flange, a portion of which abuts on the stepped portion, in a position adjacent to the press-fit portion, and wherein a space is provided between a base portion in a radial direction of the flange and the stepped portion, the space functioning as a foreign matter reservoir.

* * * * *